US006405897B1

(12) United States Patent
Jepson et al.

(10) Patent No.: US 6,405,897 B1
(45) Date of Patent: Jun. 18, 2002

(54) HAND-OPERATED SYRINGE PUMPING SYSTEM

(75) Inventors: Antonio J. Jepson, Dixon; Juha K. Salmela, Citrus Heights, both of CA (US)

(73) Assignee: Automatic Bar Controls, Inc., Vacaville, CA (US)

( * ) Notice: Subject to any disclaimer, the term of this patent is extended or adjusted under 35 U.S.C. 154(b) by 0 days.

(21) Appl. No.: 09/680,149

(22) Filed: Oct. 3, 2000

(51) Int. Cl.[7] ..... B67D 5/00
(52) U.S. Cl. ..... 222/108; 222/1; 141/116
(58) Field of Search ..... 222/108–110, 1; 141/116

(56) References Cited

U.S. PATENT DOCUMENTS 2,978,149 A * 4/1961 Rosen ..... 141/116
4,739,904 A * 4/1988 Spencer et al. ..... 222/109
5,016,687 A * 5/1991 Kawamura ..... 141/116
6,227,420 B1 * 5/2001 Jepson ..... 222/108

* cited by examiner

*Primary Examiner*—J. Casimer Jacyna
(74) *Attorney, Agent, or Firm*—Townsend and Townsend and Crew LLP

(57) ABSTRACT

A dispensing apparatus includes a chamber cavity having an inlet with an inlet check valve and an outlet with an outlet check valve. The outlet check valve is openable to permit flow substantially only in a direction from the chamber cavity out through the outlet check valve. The inlet check valve is openable to permit flow substantially only in a direction through the inlet check valve into the chamber cavity. A plunger is movable in the chamber. When the plunger is moved from a dispense position to a fill position away from the outlet and inlet check valves, it opens the inlet check valve and closes the outlet check valve and draw fluid through the inlet check valve into the chamber cavity. When the plunger is moved from the fill position to the dispense position toward the outlet and inlet check valves, it closes the inlet check valve and opens the outlet check valve and dispense fluid from the chamber cavity out through the outlet check valve. The outlet check valve is configured to close in a delayed fashion when the plunger moves from the dispense position to the fill position to allow a drawback flow from the outlet into the chamber cavity to prevent leakage and buildup of fluid at the dispensing outlet. In a preferred embodiment, the apparatus is self-contained, and is operable upon coupling to a BIB fluid source. The apparatus is easy to use and clean, and can be quickly adapted for dispensing another fluid by cleaning the pump channels and changing the BIB. No pump disassembly is required.

26 Claims, 7 Drawing Sheets

HAND-OPERATED SYRINGE PUMPING SYSTEM

BACKGROUND OF THE INVENTION

This invention relates generally to dispensing systems, and more particularly to a pump for dispensing condiments, beverages, and the like.

It is often desirable to dispense a condiment, a beverage, or the like by consistent amounts. Both mechanical and electronic devices have been used to control the portion dispensed with varying degrees of success. Some of the devices are rather complex and expensive. Some may be difficult to clean and maintain.

SUMMARY OF THE INVENTION

The present invention relates to a pump for dispensing beverages, condiments or the like. The pump includes a simple and reliable mechanism for providing consistent portion control in dispensing, and may be operated by hand. The pump includes a plunger movable in a chamber to activate an inlet check valve and an outlet check valve to fill the chamber with fluid from the inlet and dispense the fluid from the chamber through the outlet. The pump has a clean-in-place configuration that allows cleaning without disassembly by, for example, flowing a cleaning fluid through the pump. The pump desirably also includes a drawback feature at the outlet that prevents buildup at the dispensing outlet.

In accordance with an aspect of the present invention, a dispensing apparatus comprises a chamber including a cavity having an inlet and an outlet. An outlet check valve is disposed at the outlet of the chamber. The outlet check valve is openable to permit flow substantially only in a direction from the chamber cavity out through the outlet check valve. An inlet check valve is disposed at the inlet of the chamber. The inlet check valve is openable to permit flow substantially only in a direction through the inlet check valve into the chamber cavity. A plunger is disposed in the chamber. The plunger is movable from a first position to a second position away from the outlet and inlet check valves to open the inlet check valve and close the outlet check valve and draw fluid through the inlet check valve into the chamber cavity. The plunger is movable from the second position to the first position toward the outlet and inlet check valves to close the inlet check valve and open the outlet check valve and dispense fluid from the chamber cavity out through the outlet check valve.

In a preferred embodiment, the apparatus is self-contained, and is operable upon coupling to a BIB fluid source. The apparatus is easy to use and clean, and can be quickly adapted for dispensing another fluid by cleaning the pump channels and changing the BIB. No pump disassembly is required. The plunger may be coupled with a diaphragm which is attached to the chamber and extends across the chamber cavity. The diaphragm is movable in the chamber cavity by the plunger to open and close the inlet and outlet check valves. The diaphragm typically comprises a flexible elastomer.

In accordance with another aspect of the invention, a dispensing apparatus comprises a chamber including a cavity having an inlet and an outlet, an outlet valve disposed at the outlet of the chamber, and an inlet valve disposed at the inlet of the chamber. A plunger is disposed in the chamber. The plunger is movable from a first position to a second position away from the outlet and inlet valves to open the inlet valve and close the outlet valve and draw fluid through the inlet valve into the chamber cavity. The plunger is movable from the second position to the first position toward the outlet and inlet valves to close the inlet valve and open the outlet valve and dispense fluid from the chamber cavity out through the outlet valve. The outlet valve is configured to close in a delayed fashion when the plunger moves from the first position to the second position to allow a drawback flow from the outlet through the outlet valve into the chamber cavity for a preset period of time.

In accordance with another aspect of the invention, a method of dispensing a fluid comprises providing a chamber including a cavity having an inlet valve disposed at an inlet and an outlet valve disposed at an outlet. The chamber cavity is expanded to close the outlet valve and open the inlet valve to draw a fluid through the inlet valve into the chamber cavity. The chamber cavity is then contracted to close the inlet valve and open the outlet valve to dispense the fluid from the chamber cavity out through the outlet valve. Thereafter, the chamber cavity is expanded to close the outlet valve and open the inlet valve. The expansion of the chamber cavity produces a drop in pressure in the chamber cavity to draw a portion of the fluid back from the outlet through the outlet valve into the chamber cavity prior to closure of the outlet valve.

DESCRIPTION OF THE SPECIFIC EMBODIMENTS

Figure 1:
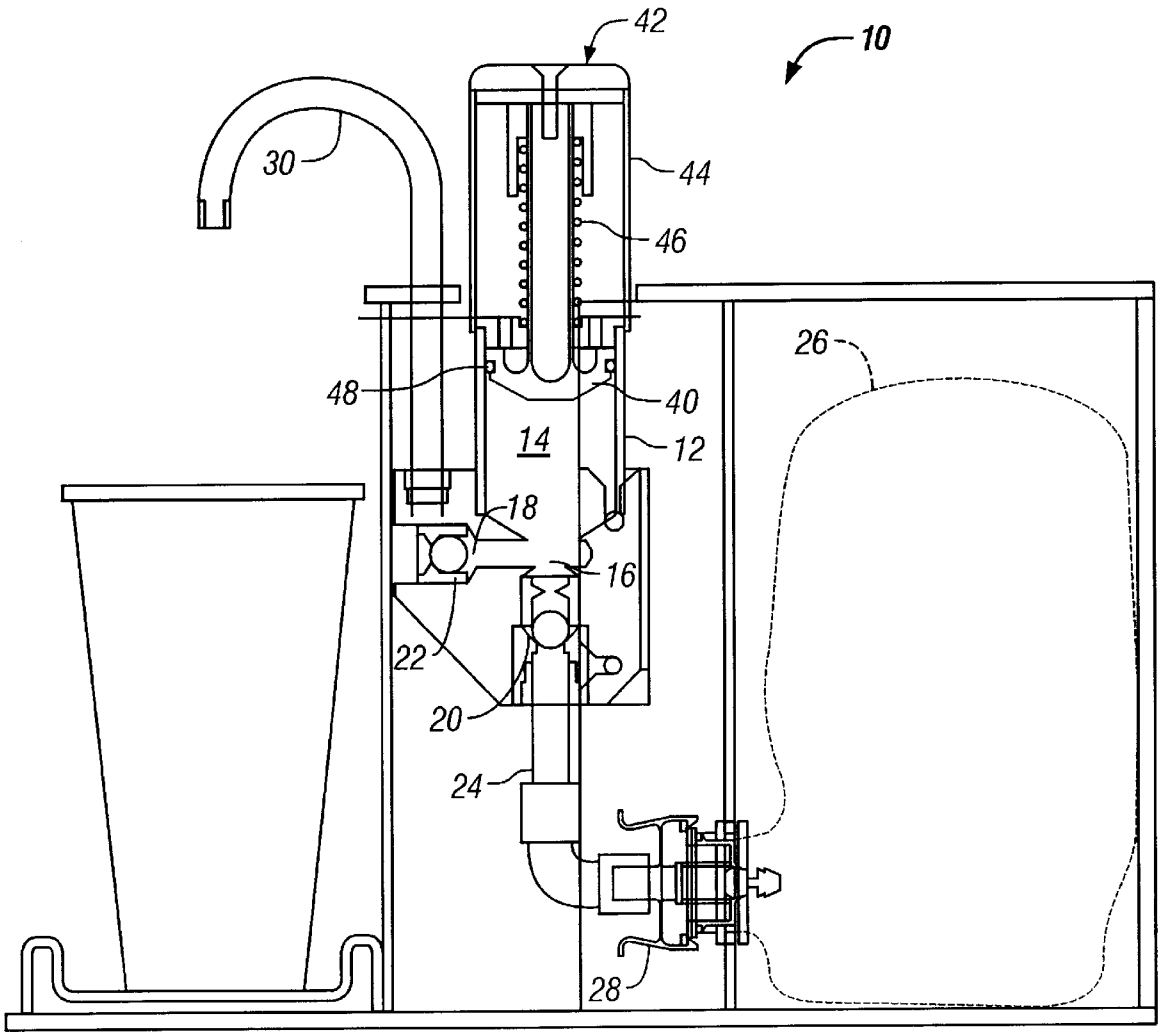
FIG. 1 is a schematic view illustrating the dispensing system in accordance with an embodiment of the present invention.

FIG. 1 shows a dispensing apparatus or pump 10 for dispensing a fluid such as a beverage, condiment, or the like. The pump 10 includes a chamber 12 having a chamber cavity 14 with an inlet 16 and an outlet 18. An inlet valve 20 is disposed at the inlet 16; an outlet valve 22 is disposed at the outlet 18. As discussed in more detail below, the inlet valve 20 and outlet valve 22 control the fluid flow through the pump 10.

The inlet 16 is connected via an inlet flow line 24 to a fluid source 26. In a specific embodiment, the source 26 is provided as a bag in box (BIB). The inlet 16 may be connected to the inlet flow line 24 by a simple interference fit or the like to facilitate quick assembly and disassembly. A quick-connect member 28 such as a snap-on connector is desirably used to couple the inlet flow line 24 to the fluid source 26. The outlet 18 is connected to a dispensing member 30 such as a gooseneck dispenser shown. The connection may employ a simple interference fit or a quick-connect member. In this way, the pump chamber 12 can be easily installed and removed for maintenance or replacement. The direct connection to an off-the-shelf BIB is advantageous and convenient because it eliminates the need to provide a reservoir for the fluid and associated maintenance and cleaning. The apparatus is self-contained, and is operable upon coupling to the BIB fluid source. The apparatus is easy to use and clean, and can be quickly adapted for dispensing another fluid by cleaning the pump channels and changing the BIB. No pump disassembly is required.

A plunger 40 is movable inside the chamber 12 to vary the volume of the cavity 14. As shown in FIG. 1, the plunger 40 is configured to slide in a generally linear manner to expand and contract the cavity 14. The plunger 40 is connected to a housing 42 having a sleeve 44 slidably coupled to the exterior of the chamber 12. A spring 46 is connected between the plunger 40 and the chamber 12 to bias the plunger 40 upward to expand the chamber cavity 14. A seal 48 such as an O-ring is provided between the plunger 40 and the interior wall of the chamber 12 to seal the cavity 14 and prevent leakage.

Figure 3:
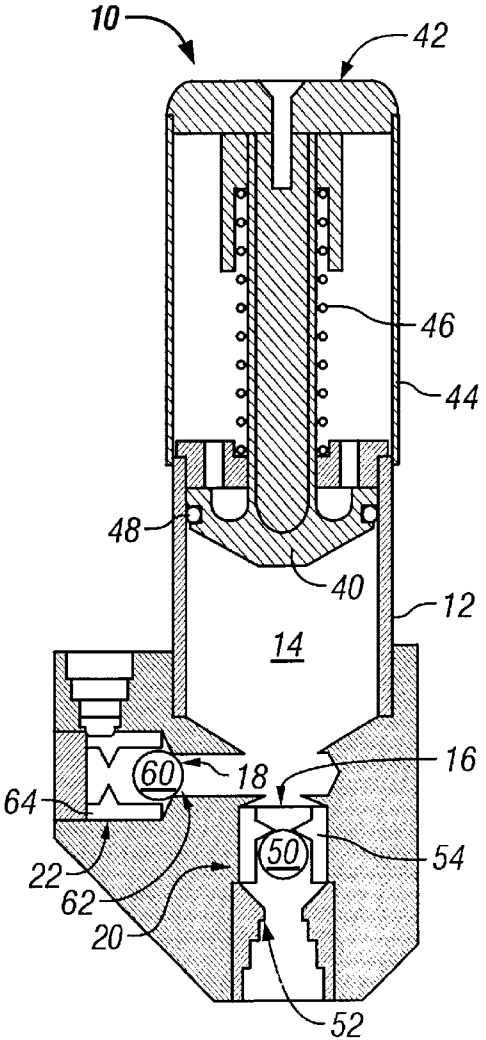
FIG. 3 is a cross-sectional view of the pump of FIG. 2 in a fill mode.
Figure 2:
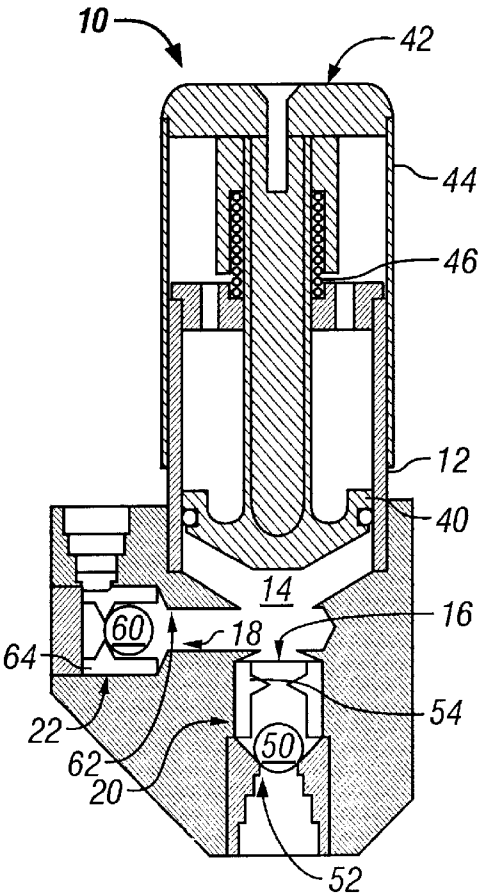
FIG. 2 is a cross-sectional view of the pump in the dispensing system of FIG. 1 in a dispense mode.

FIG. 2 shows the plunger 40 in a dispense position with the spring 46 compressed and the pump 10 in a dispense mode to dispense fluid from the cavity 14 through the outlet 18. The inlet valve 20 is closed and the outlet valve 22 is opened. FIG. 3 shows the plunger 40 in a fill position with the spring 46 returning to a less compressed position to draw fluid from the fluid source 26 through the inlet 16 into the chamber cavity 14. The inlet valve 20 is opened and the outlet valve 22 is closed.

The inlet valve 20 and outlet valve 22 desirably are check valves that automatically open and close as a result of the expansion and contraction of the chamber cavity 14. As shown in FIGS. 2 and 3, the inlet valve 20 includes an inlet valve closure member such as an inlet ball 50 which is movable between an inlet opening 52 and an inlet ball keeper 54. In this embodiment, the inlet ball 50 is disposed above the inlet opening 52, and the inlet ball keeper 54 is spaced above the inlet opening 52. The inlet ball 50 is constrained to move generally vertically between the inlet opening 52 and the inlet ball keeper 54. The outlet valve 22 includes an outlet valve closure member such as an outlet ball 60 which is movable between an outlet opening 62 and an outlet ball keeper 64. In the embodiment shown, the outlet ball keeper 64 is generally horizontally spaced from the outlet opening 62. The outlet ball 60 is constrained to move generally horizontally between the outlet opening 62 and the outlet ball keeper 64.

In the dispense mode shown in FIG. 2, the contraction of the cavity 14 raises the pressure therein, pushing the inlet ball 50 down to close the inlet opening 52 and driving the outlet ball 60 away from the outlet opening 62 toward the outlet ball keeper 64 to permit flow out of the cavity 14 through the outlet 18. In the fill mode shown in FIG. 3, the expansion of the cavity 14 draws a vacuum, which moves the outlet ball 60 to close the outlet opening 62 and lifts the inlet ball 50 away from the inlet opening 52 toward the inlet ball keeper 54 to permit flow through the inlet 16 into the cavity 14. The weight of the inlet ball 50 and the weight of the outlet ball 60 are selected to move automatically with the expansion and contraction of the chamber cavity 14 based on the pressure drop (and the associated suction force) generated during expansion and pressure rise generated during contraction. The change in pressure depends largely on the change in size of the cavity 14. Typically the pressure rise or drop increases with an increase in the change in cavity size. When the viscosity of the fluid increases, a larger pressure rise or drop is generally needed to pump the fluid.

In some situations, it may be desirable for the outlet check valve 22 to include a drawback feature. The weight of the outlet ball 60 can be selected such that the closure of the outlet check valve 22 is delayed to allow a desired amount of the fluid to be sucked back from the outlet 18. This prevents leaking or buildup of fluid such as condiment at a dispensing outlet for improved appearance and sanitary purposes. The drawback action occurs during the initial movement of the plunger 40 upward. The outlet check valve 22 closes before or shortly after the inlet check valve 20 opens to prevent direct flow from the inlet 16 to the outlet 18.

How quickly the outlet ball 60 moves to the closed position depends largely on the viscosity of the fluid and the weight of the outlet ball 60, as well as on how fast the pressure drop occurs. Typically, the higher the viscosity, the heavier is the ball 60. It is understood that to achieve the desired drawback action, the appropriate ball weight can be selected for a given type of fluid, and chamber size and configuration, which determine the suction force during closure of the outlet check valve 22.

Figure 5:
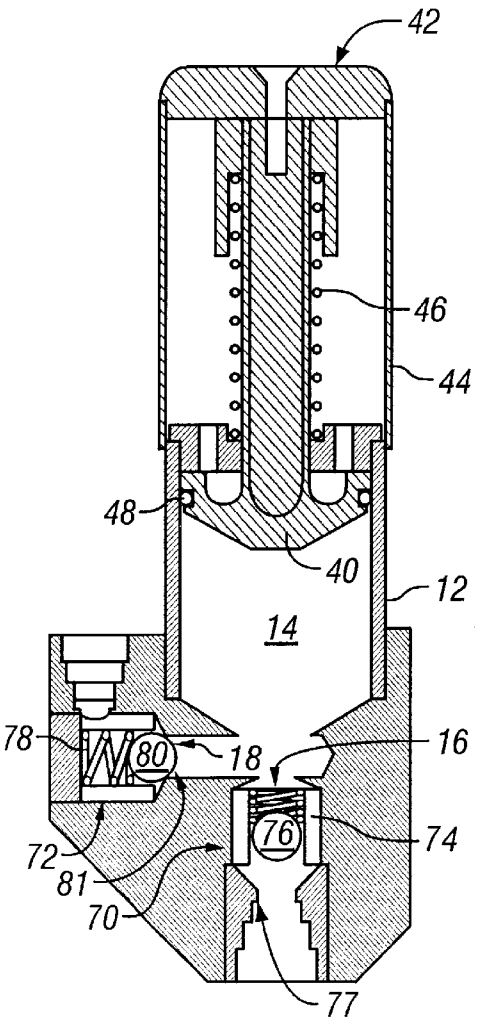
FIG. 5 is a cross-sectional view of the portion of the pump of FIG. 4 in a fill mode.
Figure 4:
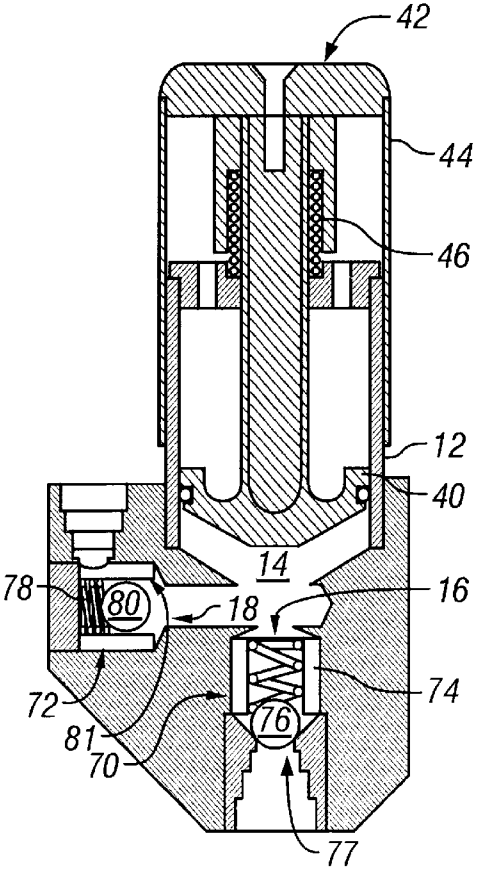
FIG. 4 is a cross-sectional view of a portion of the pump in a dispense mode illustrating another embodiment.

FIGS. 4 and 5 show an inlet check valve 70 which is a spring-loaded hat check valve movable downward to block flow and upward to permit flow therethrough. The outlet check valve 72 may also be a spring loaded hat check valve. The inlet spring 74 in the inlet check valve 70 biases the inlet ball 76 downward to close an inlet opening 77, while the outlet spring 78 in the outlet check valve 72 biases the outlet ball 80 to the right to close an outlet opening 81.

In the dispense mode shown in FIG. 4, the contraction of the cavity 14 raises the pressure therein, pushing the inlet ball 76 down to close the inlet opening 77 and driving the outlet ball 80 away from the outlet opening 81 against the outlet spring 78 to permit flow out of the cavity 14 through the outlet 18. In the fill mode shown in FIG. 5, the expansion of the cavity 14 draws a vacuum, which moves the outlet ball 80 to close the outlet opening 81 and lifts the inlet ball 76 away from the inlet opening 77 against the inlet spring 74 to permit flow through the inlet 16 into the cavity 14. The weight of the inlet ball 76 and the weight of the outlet ball 80, as well as the spring constants of the inlet spring 74 and the outlet spring 78, are selected to move automatically with the expansion and contraction of the chamber cavity 14 based on the pressure drop (and the associated suction force) generated during expansion and pressure rise generated during contraction.

In some situations, it may be desirable for the outlet check valve 72 to include a drawback feature. The weight of the outlet ball 80 and the spring constant of the outlet spring 78 can be selected such that the closure of the outlet check valve 72 is delayed and a desired amount of the fluid is sucked back from the outlet 18. This prevents leaking or buildup of fluid such as condiment at a dispensing outlet for improved appearance and sanitary purposes. How quickly the outlet ball 80 moves to the closed position depends largely on the viscosity of the fluid, the weight of the outlet ball 80, and the spring constant of the outlet spring 78, as well as on how fast the pressure drop occurs. Typically, the higher the viscosity, the higher is the spring constant for the outlet spring 78. It is understood that to achieve the desired drawback action, the appropriate ball weight and spring constant can be selected for a given type of fluid, and chamber size and configuration, which determine the suction force during closure of the outlet check valve 72.

In operation, the plunger 40 is pushed downward manually to the bottom position for dispensing fluid from the chamber cavity 14. Upon release of the downward force, the spring 46 moves the plunger 40 upward and automatically returns it to the top position for filling the cavity 14. The plunger 40 is constrained to move between the top and bottom positions to produce a uniform change in the size of the cavity 14 and hence portion control of the amount of fluid dispensed. The pump 10 provides a simple mechanism for reliably providing consistent portion control dispensing operation.

The stroke of the plunger 40 may be limited by the spring 46, but may also be set by adjusting the length of the sleeve 44 which limits the downward movement of the plunger 40 as it runs up against the body of the pump. An increase in the length of the sleeve 44 will reduce the plunger stroke. It is possible to replace the housing 42 with a sleeve 44 having a desired length to adjust the plunger stroke and adapt the pump to achieve the desired pumping for a particular fluid under specified operating conditions. The replacement of the housing 42 is relatively simple and quick by loosening and applying fasteners used to connect the housing 42 to the plunger 40.

The components of the pump 10 may be made by any suitable methods, including injection molding. The pump configuration lends itself to a clean-in-place process whereby a cleaning fluid can be flowed through the pump 10 for cleaning without disassembly. The cleaning fluid enters the inlet 16, passes through the chamber cavity 14, and exits the outlet 18, cleaning all surfaces that have been exposed to the condiment, beverage, or the like.

Figure 6:
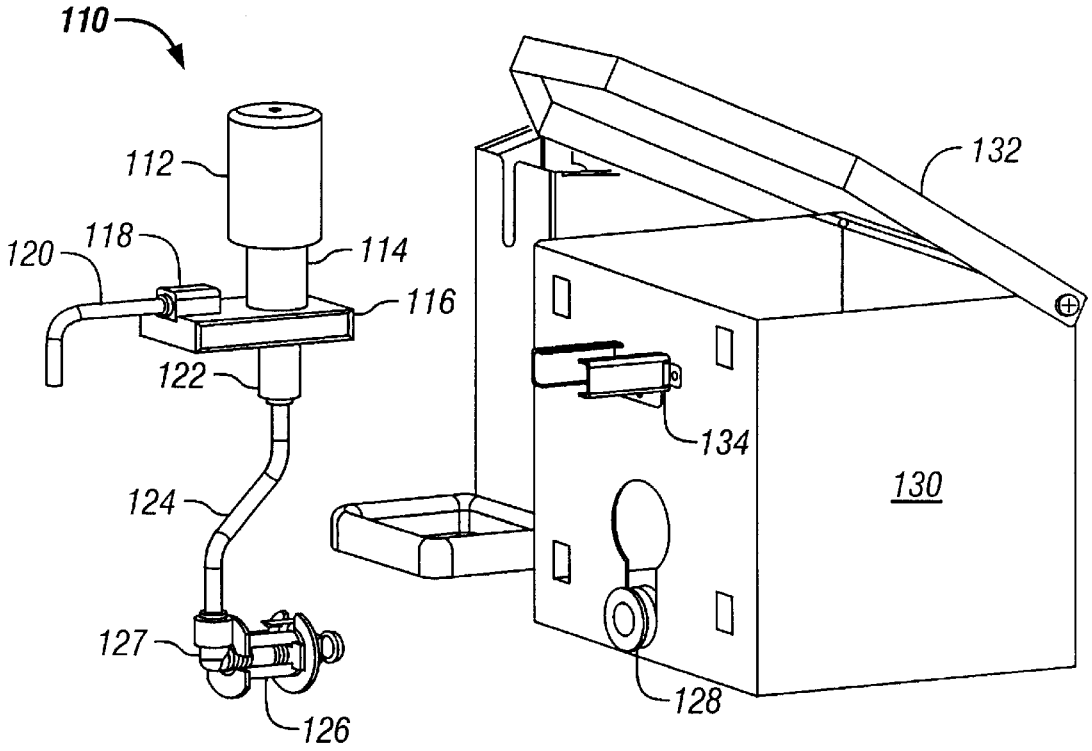
FIG. 6 is a perspective view of a dispensing system in accordance with another embodiment of the present invention.
Figure 7:
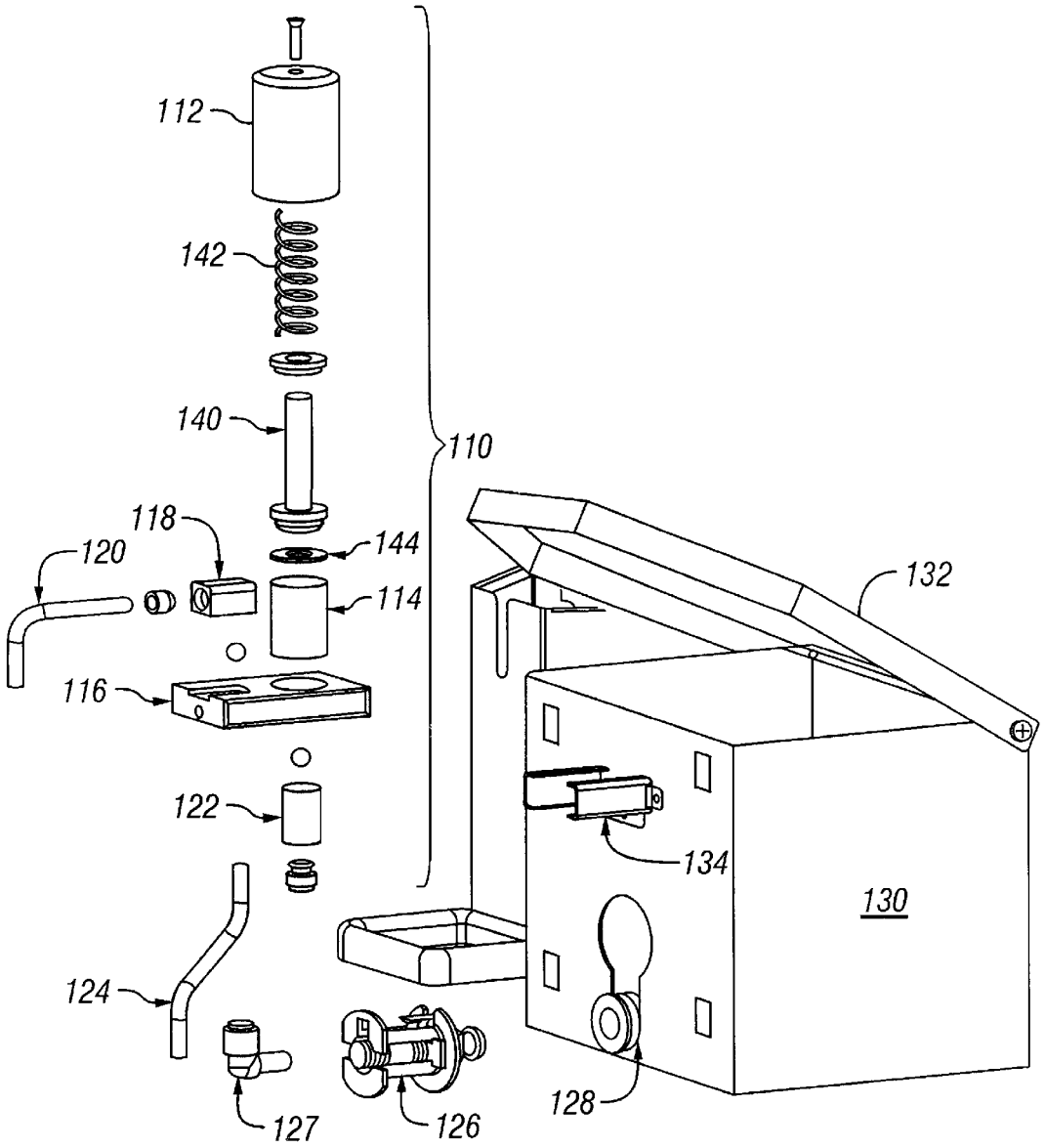
FIG. 7 is an exploded perspective view of the dispensing system of FIG. 6.
Figure 8:
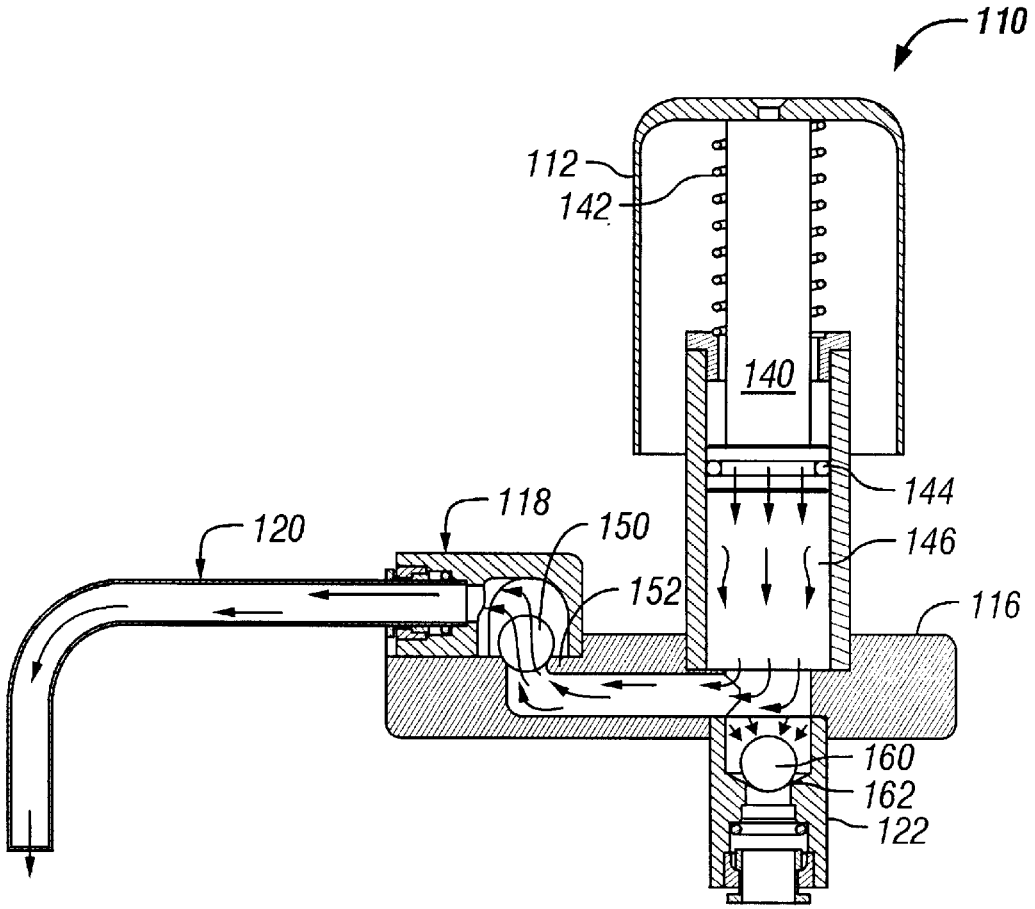
FIG. 8 is a cross-sectional view of the dispensing system of FIG. 6.

FIGS. 6–8 show a dispensing apparatus 110 according to another embodiment. The apparatus 110 includes a plunger housing 112 movably coupled with a pump chamber 114 supported on a pump body 116. An outlet valve housing 118 is coupled between the pump body 116 and an outlet spout 120. An inlet valve housing 122 is coupled between the pump body 116 and a delivery tube 124, which is coupled with a connector 126 by a fitting 127. The connector 126 is detachably coupled to a spout or outlet 128 of a fluid source such as a BIB disposed in the box 130. The box 130 has a lid 132 for installing and removing the BIB. A pump mounting bracket 134 is provided on the side of the box 130 for mounting the pump body 116.

As best seen in FIGS. 7 and 8, a plunger 140 is movable inside the pump chamber 114 and is connected to the plunger housing 112. A spring 142 is connected between the plunger 140 and the chamber 114 to bias the plunger 140 upward to expand the cavity 146 of the chamber 114. A seal 144 is provided between the plunger 140 and the interior wall of the chamber 114 to seal the chamber cavity 146.

An outlet ball 150 is disposed at an outlet opening 152 of the outlet valve housing 118 in a closed position, and is movable upward by a sufficient pressure to permit fluid flow in an open position. An inlet ball 160 is disposed at an inlet opening 162 of the inlet valve housing 122, and is movable upward by a sufficient pressure to permit fluid flow in an open position. In the embodiment shown, the inlet and outlet balls 150, 160 are biased toward the closed positions by gravity. In an alternate embodiment, springs or other biasing members may be used. The operation of the pump apparatus 110 is similar to that of the pump apparatus 10 described above in connection with FIGS. 1–5.

Figure 9:
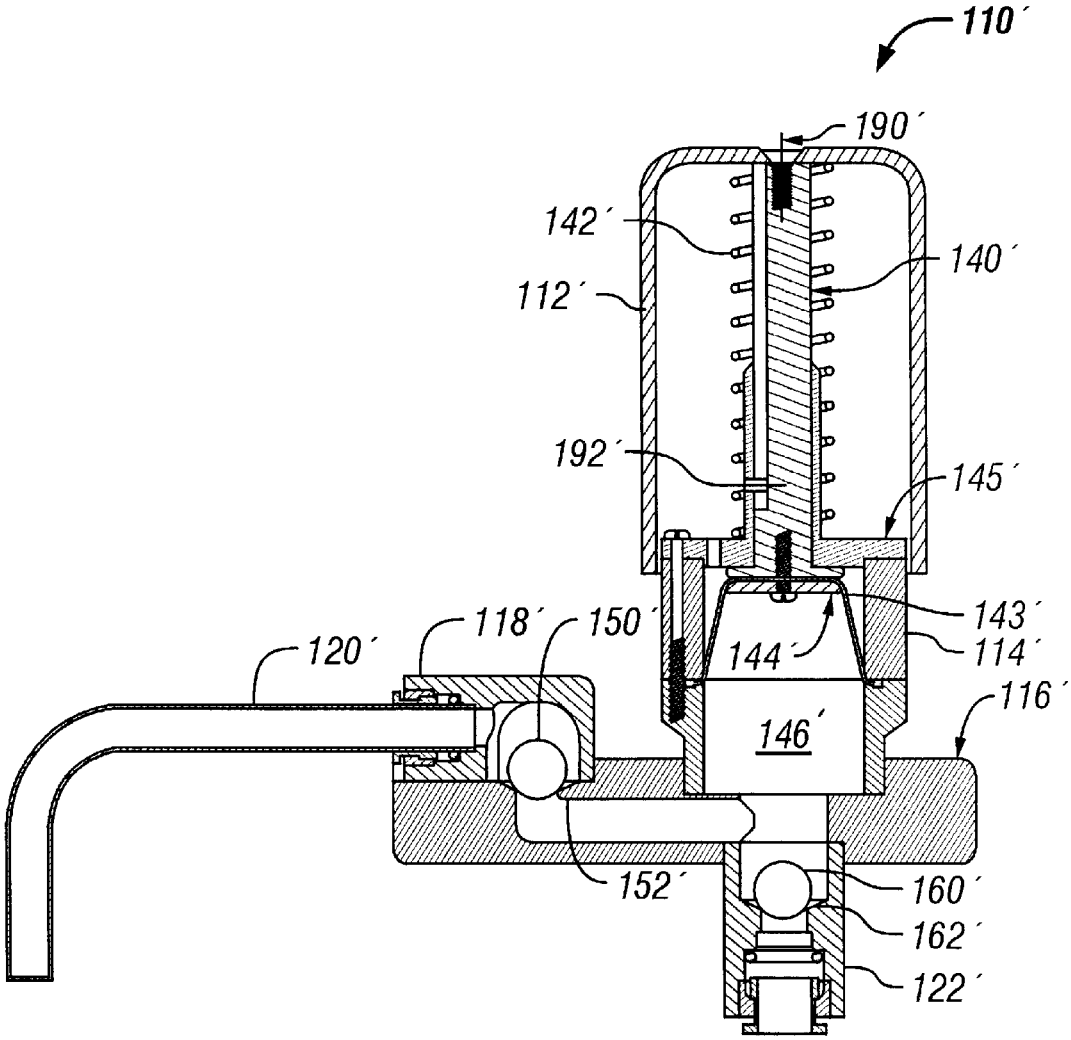
FIG. 9 is a cross-sectional view of a dispensing system in accordance with another embodiment of the present invention.

FIG. 9 shows yet another embodiment of the apparatus 110' which is similar to the apparatus 110 of FIGS. 6–8. Instead of the piston at the end of the plunger 140, the apparatus 110' in FIG. 9 includes a flexible member serving as a rolling diaphragm piston 143' for changing the volume of the chamber cavity 146' and for opening and closing the inlet and outlet check valves by moving the inlet and outlet balls 150', 160'. The diaphragm 143' is attached along the side wall of the chamber 114' and extends over the cross-section of the cavity 146' of the chamber 114'. The diaphragm 143' is attached to the plunger 140' by a diaphragm retainer 144' to move with the plunger 140'. The plunger 140' is guided by a plunger guide 145' and resiliently biased by the spring 142' upward to expand the chamber cavity 146'. The use of the diaphragm 143' eliminates sliding of a piston over the side wall of the chamber 114' and the need for a sliding seal. The diaphragm 143' is typically made of a flexible elastomer such as silicone and desirably has good strength properties and is compatible with food products such as beverages and condiments. Example of a suitable material is EPDM.

As shown in FIG. 9, a fastener 190' couples the plunger housing 112' to the plunger 140', and desirably permits rotation of the housing 112' relative to the plunger 140' around it axis. An anti-rotation pin 192' connects the plunger 140' to the plunger guide 145'. Of course, other ways of configuring the components of the apparatus may be used in alternative embodiments.

The above-described arrangements of apparatus and methods are merely illustrative of applications of the principles of this invention and many other embodiments and modifications may be made without departing from the spirit and scope of the invention as defined in the claims. For instance, an automated drive mechanism may be used for moving the plunger. In addition, the chamber may have other shapes, and the plunger may be configured to move in a nonlinear manner. Moreover, FIGS. 2–5 show specific embodiments having a vertically disposed inlet valve and a horizontally disposed outlet valve. Alternate arrangements of the valves may be used, provided that the appropriate ball weight and/or spring constants are selected. The scope of the invention should, therefore, be determined not with reference to the above description, but instead should be determined with reference to the appended claims along with their full scope of equivalents.

What is claimed is:

1. A dispensing apparatus comprising:

a chamber including a cavity having an inlet and an outlet;

an outlet check valve disposed at the outlet of the chamber, the outlet check valve being openable to permit flow substantially only in a direction from the chamber cavity out through the outlet check valve;

an inlet check valve disposed at the inlet of the chamber, the inlet check valve being openable to permit flow substantially only in a direction through the inlet check valve into the chamber cavity;

a flexible diaphragm having a first portion attached to the chamber, the diaphragm extending across the chamber cavity; and a plunger disposed in the chamber with a second portion of the diaphragm mounted to the plunger to move with the plunger relative to the first portion of the diaphragm attached to the chamber, the plunger being movable to deflect the diaphragm from a first position to a second position away from the outlet and inlet check valves to open the inlet check valve and close the outlet check valve and draw fluid through the inlet check valve into the chamber cavity, the plunger being movable to deflect the diaphragm from the second position to the first position toward the outlet and inlet check valves to close the inlet check valve and open the outlet check valve and dispense fluid from the chamber cavity out through the outlet check valve.

2. The apparatus of claim 1 wherein the outlet check valve comprises an outlet valve closure member biased toward an outlet opening to close the outlet opening.

3. The apparatus of claim 2 wherein the outlet valve closure member is a ball connected to a spring which is disposed opposite from the chamber cavity and which biases the ball toward the outlet opening.

4. The apparatus of claim 1 wherein the outlet check valve comprises an outlet valve closure member moving toward an outlet opening to close the outlet opening when the plunger is moved from the first position to the second position away from the outlet check valve to produce a pressure drop in the chamber cavity, the outlet valve closure member moving away from the outlet opening to permit flow therethrough when the plunger is moved from the second position to the first position toward the outlet check valve to produce a pressure rise in the chamber cavity.

5. The apparatus of claim 4 wherein movement of the plunger from the first position and the second position draws a portion of the flow back from the outlet through the outlet check valve into the chamber cavity prior to closure of the outlet check valve.

6. The apparatus of claim 5 wherein the outlet check valve is configured to close in a delayed fashion when the plunger moves from the first position to the second position to allow drawback of the portion of the flow from the outlet through the outlet check valve into the chamber cavity.

7. The apparatus of claim 1 wherein the outlet check valve comprises an outlet ball movable between an outlet opening to close the outlet opening and an outlet ball keeper which supports the ball in a position spaced from the outlet opening to permit flow through the outlet opening.

8. The apparatus of claim 7 wherein the inlet check valve comprises an inlet ball disposed above an inlet opening and an inlet ball keeper spaced above the inlet opening, the inlet ball movable between the inlet opening to close the inlet opening and the inlet ball keeper to permit flow through the inlet opening.

9. The apparatus of claim 8 wherein the outlet ball keeper is generally horizontally spaced from the outlet opening.

10. The apparatus of claim 8 wherein the outlet check valve comprises an outlet ball disposed above an outlet opening and an outlet ball keeper spaced above the outlet opening, the outlet ball movable between the outlet opening to close the outlet opening and the outlet ball keeper to permit flow through the outlet opening.

11. The apparatus of claim 1 wherein the plunger is biased by a spring toward the second position.

12. The apparatus of claim 1 wherein the plunger includes a portion which is slidably coupled with a side wall of the chamber with a sliding seal therebetween.

13. The apparatus of claim 1 wherein the plunger is coupled with a center portion of the diaphragm which has a periphery portion that is attached to the chamber and wherein the diaphragm extends across the chamber cavity to form a boundary for the flow entering through the inlet check valve and exiting the outlet check valve.

14. The apparatus of claim 1 wherein the diaphragm comprises a flexible elastomer.

15. A dispensing apparatus comprising:

a chamber including a cavity having an inlet and an outlet;

an outlet check valve disposed at the outlet of the chamber, the outlet check valve being openable to permit flow substantially only in a direction from the chamber cavity out through the outlet check valve;

an inlet check valve disposed at the inlet of the chamber, the inlet check valve being openable to permit flow substantially only in a direction through the inlet check valve into the chamber cavity;

a plunger disposed in the chamber, the plunger being movable from a first position to a second position away from the outlet and inlet check valves to open the inlet check valve and close the outlet check valve and draw fluid through the inlet check valve into the chamber cavity, the plunger being movable from the second position to the first position toward the outlet and inlet check valves to close the inlet check valve and open the outlet check valve and dispense fluid from the chamber cavity out through the outlet check valve; and a fluid source container having an outlet detachably coupled with the inlet check valve, the fluid source container comprising a bag-in-box container.

16. The apparatus of claim 11 further comprising a box for housing the bag-in-box container, the box including a mounting bracket for mounting the chamber to an exterior side of the box.

17. A dispensing apparatus comprising:

a chamber including a cavity having an inlet and an outlet;

an outlet valve disposed at the outlet of the chamber;

an inlet valve disposed at the inlet of the chamber;

a flexible diaphragm having a first portion attached to the chamber, the diaphragm extending across the chamber cavity; and a plunger disposed in the chamber with a second portion of the diaphragm mounted to the plunger to move with the plunger relative to the first portion of the diaphragm attached to the chamber, the plunger being movable to deflect the diaphragm from a first position to a second position away from the outlet and inlet valves to open the inlet valve and close the outlet valve and draw fluid through the inlet valve into the chamber cavity, the plunger being movable to deflect the diaphragm from the second position to the first position toward the outlet and inlet valves to close the inlet valve and open the outlet valve and dispense fluid from the chamber cavity out through the outlet valve, wherein the outlet valve is configured to close in a delayed fashion when the plunger moves from the first position to the second position to allow a drawback flow from the outlet through the outlet valve into the chamber cavity for a preset period of time.

18. The apparatus of claim 17 wherein the outlet valve comprises a ball connected to a spring which is disposed opposite from the chamber cavity and which biases the ball toward an outlet opening, the spring having a spring constant selected to bias the ball to close the outlet opening to close the outlet valve in a delayed fashion when the plunger moves from the first position to the second position.

19. The apparatus of claim 17 wherein the outlet valve comprises an outlet ball movable between an outlet opening to close the outlet opening and an outlet ball keeper which supports the ball in a position spaced from the outlet opening to permit flow through the outlet opening.

20. The apparatus of claim 19 wherein the outlet ball keeper is generally horizontally spaced from the outlet opening.

21. The apparatus of claim 17 wherein the plunger includes a sleeve slidably coupled to the chamber.

22. A method of dispensing a fluid, the method comprising:

providing a chamber including a cavity having an inlet valve disposed at an inlet and an outlet valve disposed at an outlet, a plunger disposed in the chamber, and a flexible diaphragm having a first portion attached to the chamber and a second portion mounted to the plunger, the diaphragm extending across the chamber cavity, the plunger being movable to deflect the flexible diaphragm to expand and contract the chamber cavity;

expanding the chamber cavity by moving the plunger to deflect the flexible diaphragm in a first direction to close the outlet valve and open the inlet valve to draw a fluid through the inlet valve into the chamber cavity;

thereafter, contracting the chamber cavity by moving the plunger to deflect the flexible diaphragm in a second direction opposite from the first direction to close the inlet valve and open the outlet valve to dispense the fluid from the chamber cavity out through the outlet valve; and thereafter, expanding the chamber cavity by moving the plunger to deflect the flexible diaphragm in the first direction to close the outlet valve and open the inlet valve, wherein expanding the chamber cavity produces a drop in pressure in the chamber cavity to draw a portion of the fluid back from the outlet through the outlet valve into the chamber cavity prior to closure of the outlet valve.

23. The method of claim 22 wherein the outlet valve is selected to close in a delayed fashion during expansion of the chamber cavity to permit drawback of a preset portion of the fluid from the outlet through the outlet valve into the chamber cavity.

24. The method of claim 22 wherein the inlet valve is selected to open only when the pressure upstream of the inlet outside of the chamber cavity is sufficiently higher than the pressure inside the chamber cavity.

25. The method of claim 22 wherein the outlet valve is biased toward a closed position by a biasing force, the biasing force being selected to close the outlet valve a preset period of time during expansion of the chamber cavity to permit drawback of a portion of the fluid from the outlet through the outlet valve into the chamber cavity.

26. The method of claim 22 wherein the chamber cavity is contracted by a user applying a force, and is expanded automatically by a biasing force.

* * * * *